US010605041B2

(12) United States Patent
Noui-Mehidi

(10) Patent No.: US 10,605,041 B2
(45) Date of Patent: Mar. 31, 2020

(54) SYSTEM AND METHOD FOR ISOLATING A WELLBORE ZONE FOR RIGLESS HYDRAULIC FRACTURING

(71) Applicant: Saudi Arabian Oil Company, Dhahran (SA)

(72) Inventor: Mohamed Nabil Noui-Mehidi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/002,410

(22) Filed: Jun. 7, 2018

(65) Prior Publication Data

US 2019/0376361 A1 Dec. 12, 2019

(51) Int. Cl.
*E21B 33/124* (2006.01)
*E21B 33/128* (2006.01)
(Continued)

(52) U.S. Cl.
CPC ..... *E21B 33/1285* (2013.01); *E21B 33/124* (2013.01); *E21B 34/14* (2013.01); *E21B 43/26* (2013.01)

(58) Field of Classification Search
CPC .... E21B 33/124; E21B 33/1285; E21B 34/14; E21B 43/26
See application file for complete search history.

(56) References Cited

U.S. PATENT DOCUMENTS 1,802,525 A * 4/1931 Newlin ..... E21B 37/08 166/147
4,423,783 A * 1/1984 Haag ..... E21B 17/1028 166/120

(Continued)

FOREIGN PATENT DOCUMENTS

WO 2014177886 A2 11/2014
WO 2017039661 A1 3/2017
WO 2017074733 A1 5/2017

OTHER PUBLICATIONS

MultiCycle Frac Sleeve; NCS Multistage; http://0414fd5.netsolhost.com/fracturing-systems/multicycle-frac-sleeve/.

(Continued)

*Primary Examiner* — Matthew R Buck
(74) *Attorney, Agent, or Firm* — Bracewell LLP; Constance G. Rhebergen; Linda L. Morgan

(57) ABSTRACT

Systems and methods for hydraulically fracturing a subterranean formation include a fracturing assembly with a tool body having a central bore. A downhole isolating assembly is moveable between a downhole unengaged position and a downhole engaged position. A downhole piston assembly is moveable between a downhole piston contracted position and a downhole piston extended position and is operable to move the downhole isolating assembly between the downhole unengaged position and the downhole engaged position. An uphole isolating assembly is moveable between an uphole unengaged position and an uphole engaged position. An uphole piston assembly is moveable between an uphole piston contracted position and an uphole piston extended position, where the uphole piston assembly is operable to move the uphole isolating assembly between the uphole unengaged position and the uphole engaged position.

27 Claims, 4 Drawing Sheets

(51) Int. Cl.
*E21B 34/14* (2006.01)
*E21B 43/26* (2006.01)

(56) References Cited

U.S. PATENT DOCUMENTS

| | | | | |
|---|---|---|---|---|
| RE31,842 | E * | 3/1985 | Weitz | E21B 37/08 166/147 |
| 4,519,456 | A * | 5/1985 | Cochran | E21B 37/08 166/147 |
| 4,569,396 | A * | 2/1986 | Brisco | E21B 33/124 166/185 |
| 5,517,854 | A | 5/1996 | Plumb et al. | |
| 7,051,812 | B2 * | 5/2006 | McKee | E21B 33/08 166/186 |
| 7,527,095 | B2 | 5/2009 | Bloess et al. | |
| 8,201,631 | B2 | 6/2012 | Stromquist et al. | |
| 8,726,996 | B2 * | 5/2014 | Busaidy | E21B 33/124 166/191 |
| 8,794,331 | B2 | 8/2014 | Getzlaf et al. | |
| 9,115,559 | B2 | 8/2015 | Al-Anazi | |
| 9,494,010 | B2 * | 11/2016 | Flores | E21B 33/124 |
| 9,506,333 | B2 | 11/2016 | Castillo et al. | |
| 9,708,906 | B2 | 7/2017 | Frost et al. | |
| 9,810,036 | B2 | 11/2017 | Mailand et al. | |
| 10,012,052 | B2 * | 7/2018 | Bergland | E21B 33/124 |
| 2007/0227725 | A1 | 10/2007 | Xu et al. | |
| 2008/0066917 | A1 | 3/2008 | Lehr et al. | |
| 2014/0290944 | A1 | 10/2014 | Kristoffer | |
| 2017/0183931 | A1 | 6/2017 | Jani | |

OTHER PUBLICATIONS

International Search Report and Written Opinion for related PCT application PCT/US2019/035224 dated Sep. 2, 2019.

* cited by examiner

SYSTEM AND METHOD FOR ISOLATING A WELLBORE ZONE FOR RIGLESS HYDRAULIC FRACTURING

BACKGROUND OF THE DISCLOSURE

1. Field of the Disclosure

The present disclosure relates to operations in a wellbore associated with the production of hydrocarbons. More specifically, the disclosure relates to systems and methods for enhancing flow from a targeted subterranean formation by fracturing the targeted subterranean formation.

2. Description of the Related Art

The branch of petroleum engineering called wellbore stimulation includes the task of enhancing flow of production fluids from a subterranean formation to the wellbore. To produce fluids from the targeted hydrocarbon formation, the fluid in the subterranean formation needs to be in communication with the wellbore. The flow from the subterranean formation to the wellbore is by way of formation permeability. In tight formations when such permeability is low, stimulation can be applied around the wellbore and into the formation to enhance the flow and build a network of communication lines between the subterranean formation and the wellbore.

A method of initiating a network of communication between the subterranean formation and the wellbore is by pumping fluids through an isolated downhole device in the wellbore. The fluid is pumped such that the pressure exceeds the formation breaking pressure and causes the subterranean formation and surrounding rocks to break and become fractured. This procedure is called hydraulic fracturing and can be carried out using a water based fluid called hydraulic fracture fluid. Hydraulic fracturing produces fractures in the subterranean formation and creates networking between the subterranean formation and the wellbore.

SUMMARY OF THE DISCLOSURE

In the case of a subterranean well with an open hole, well stimulation with hydraulic fracturing requires mechanical isolation of the target zones. In current systems, zonal isolation can be achieved by using mechanical packers that are installed in sequence. The mechanical packers can be installed with rigs and removed after the hydraulic fracturing operation ends to be re-installed at a different zone. This method is time consuming and involves the use of drilling rigs.

Embodiments of this disclosure provide systems and methods for hydraulic fracturing with a fracturing assembly that is deployed riglessly with coiled tubing in a single trip. The fracturing assembly has as uphole and downhole isolating assemblies that are engaged hydraulically to isolate a zone of the wellbore for hydraulic fracturing purposes. The same fluid that is used to engage the uphole and downhole isolating assemblies can be used for the hydraulic fracturing operations.

In an embodiment of this disclosure, a fracturing assembly for hydraulically fracturing a subterranean formation includes a tool body. The tool body has a central bore. The fracturing assembly also includes a downhole isolating assembly. The downhole isolating assembly is moveable between a downhole unengaged position and a downhole engaged position. In the downhole engaged position the downhole isolating assembly is operable to form a seal with an inner diameter surface of a wellbore. The fracturing assembly further includes a downhole piston assembly. The downhole piston assembly is in fluid communication with the central bore of the tool body. The downhole piston assembly is moveable between a downhole piston contracted position and a downhole piston extended position. The downhole piston assembly is operable to move the downhole isolating assembly between the downhole unengaged position and the downhole engaged position. An uphole isolating assembly is moveable between an uphole unengaged position and an uphole engaged position. In the uphole engaged position the uphole isolating assembly is operable to form a seal with the inner diameter surface of the wellbore. An uphole piston assembly is moveable between an uphole piston contracted position and an uphole piston extended position. The uphole piston assembly is in fluid communication with the central bore of the tool body when the downhole piston assembly is in the downhole piston extended position. The uphole piston assembly is operable to move the uphole isolating assembly between the uphole unengaged position and the uphole engaged position.

In an alternate embodiment the downhole isolating assembly can be biased towards the downhole piston contracted position. The uphole isolating assembly can be biased towards the uphole piston contracted position. The tool body can further include an annular space between an outside surface of an inner tubular member and an inner diameter surface of an outer tubular member. The uphole piston assembly can include an uphole piston member that is ring shaped and that forms a seal in the annular space of the tool body.

In other alternate embodiments, the uphole piston assembly can further include a plurality of uphole piston rods. Each of the plurality of uphole piston rods can be static relative to the tool body. The uphole piston member can be operable to slide along the plurality of uphole piston rods. The tool body can further include an uphole port extending through the outer tubular member. The uphole piston member can be located downhole of the uphole port when the uphole piston assembly is in the uphole unengaged position. The uphole piston member can be located uphole of the uphole port when the uphole piston assembly is in the uphole engaged position.

In yet other alternate embodiments, the downhole piston assembly can include a downhole piston member that forms a seal around an inner diameter surface of the central bore of the tool body. The downhole piston assembly can further include a downhole piston rod that is static relative to the tool body. The downhole piston member can be operable to slide along the downhole piston rod. The tool body can further include an inner tubular member that defines the central bore. A downhole port can extend through the inner tubular member. The downhole piston member can be located uphole of the downhole port when the downhole piston assembly is in the downhole piston contracted position. The downhole piston member can be located downhole of the downhole port when the downhole piston assembly is in the downhole piston extended position.

In still other alternate embodiments, the downhole isolating assembly can include a downhole structural assembly having a plurality of downhole linear members and a plurality of downhole pivoting members. The downhole isolating assembly can further include a downhole sealing member. Each of the plurality of downhole linear members can be secured to one of the plurality of downhole pivoting members. Each of the plurality of downhole pivoting members can be secured to the downhole sealing member. The uphole isolating assembly can include an uphole structural assembly having a plurality of uphole linear members, and a plurality of uphole pivoting members. The uphole isolating assembly can further include an uphole sealing member. Each of the plurality of uphole linear members can be secured to one of the plurality of uphole pivoting members. Each of the plurality of uphole pivoting members can be secured to the uphole sealing member. The central bore of the tool body can be in fluid communication with the wellbore when the downhole isolating assembly is in the downhole engaged position and the uphole isolating assembly is in the uphole engaged position.

In an alternate embodiment of this disclosure a method for hydraulically fracturing a subterranean formation with a fracturing assembly includes providing a tool body having a central bore. A downhole isolating assembly is also provided. The downhole isolating assembly is moveable between a downhole unengaged position and a downhole engaged position. In the downhole engaged position the downhole isolating assembly forms a seal with an inner diameter surface of a wellbore. A downhole piston assembly is in fluid communication with the central bore of the tool body. The downhole piston assembly is moveable between a downhole piston contracted position and a downhole piston extended position. An uphole isolating assembly is moveable between an uphole unengaged position and an uphole engaged position. In the uphole engaged position the uphole isolating assembly forms a seal with the inner diameter surface of the wellbore. An uphole piston assembly is moveable between an uphole piston contracted position and an uphole piston extended position. The uphole piston assembly is in fluid communication with the central bore of the tool body when the downhole piston assembly is in the downhole piston extended position. The downhole isolating assembly is moved between the downhole unengaged position and the downhole engaged position with the downhole piston assembly. The uphole isolating assembly is moved between the uphole unengaged position and the uphole engaged position with the uphole piston assembly.

In alternate embodiments, the method can further include biasing the downhole isolating assembly towards the downhole piston contracted position. The uphole isolating assembly can be biased towards the uphole piston contracted position. An annular space between an outside surface of an inner tubular member of the tool body and an inner diameter surface of an outer tubular member of the tool body can be sealed with an uphole piston member of the uphole piston assembly. The uphole piston assembly can be moved between the uphole piston contracted position and the uphole piston extended position by sliding the uphole piston member along a plurality of uphole piston rods. Each of the plurality of uphole piston rods can be static relative to the tool body. The outer tubular member can have an uphole port extending through the outer tubular member. The method can further include moving the uphole piston member from downhole of the uphole port to uphole of the uphole port by moving the uphole piston assembly from the uphole unengaged position to the uphole engaged position.

In other alternate embodiments, the method can include forming a seal around an inner diameter surface of the central bore of the tool body with a downhole piston member of the downhole piston assembly. The downhole piston assembly can be moved between the downhole piston contracted position and the downhole piston extended position by sliding the downhole piston member along a downhole piston rod. The downhole piston rod can be static relative to the tool body.

In yet other alternate embodiments, the tool body further can further include an inner tubular member that defines the central bore and a downhole port can extend through the inner tubular member. The method can further include moving the downhole piston member from uphole of the downhole port to downhole of the downhole port by moving the downhole piston assembly from the downhole piston contracted position to the downhole piston extended position. The central bore of the tool body can be in fluid communication with the wellbore when the downhole isolating assembly is in the downhole engaged position and the uphole isolating assembly is in the uphole engaged position.

In still other alternate embodiments, moving the downhole isolating assembly from the downhole unengaged position to the downhole engaged position with the downhole piston assembly can include injecting a pressure fluid through the central bore. Moving the uphole isolating assembly from the uphole unengaged position to the uphole engaged position with the uphole piston assembly can include injecting the pressure fluid through the central bore after the downhole isolating assembly is in the downhole engaged position. The method can further include fracturing the subterranean formation with the pressure fluid after the uphole isolating assembly is in the uphole engaged position.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
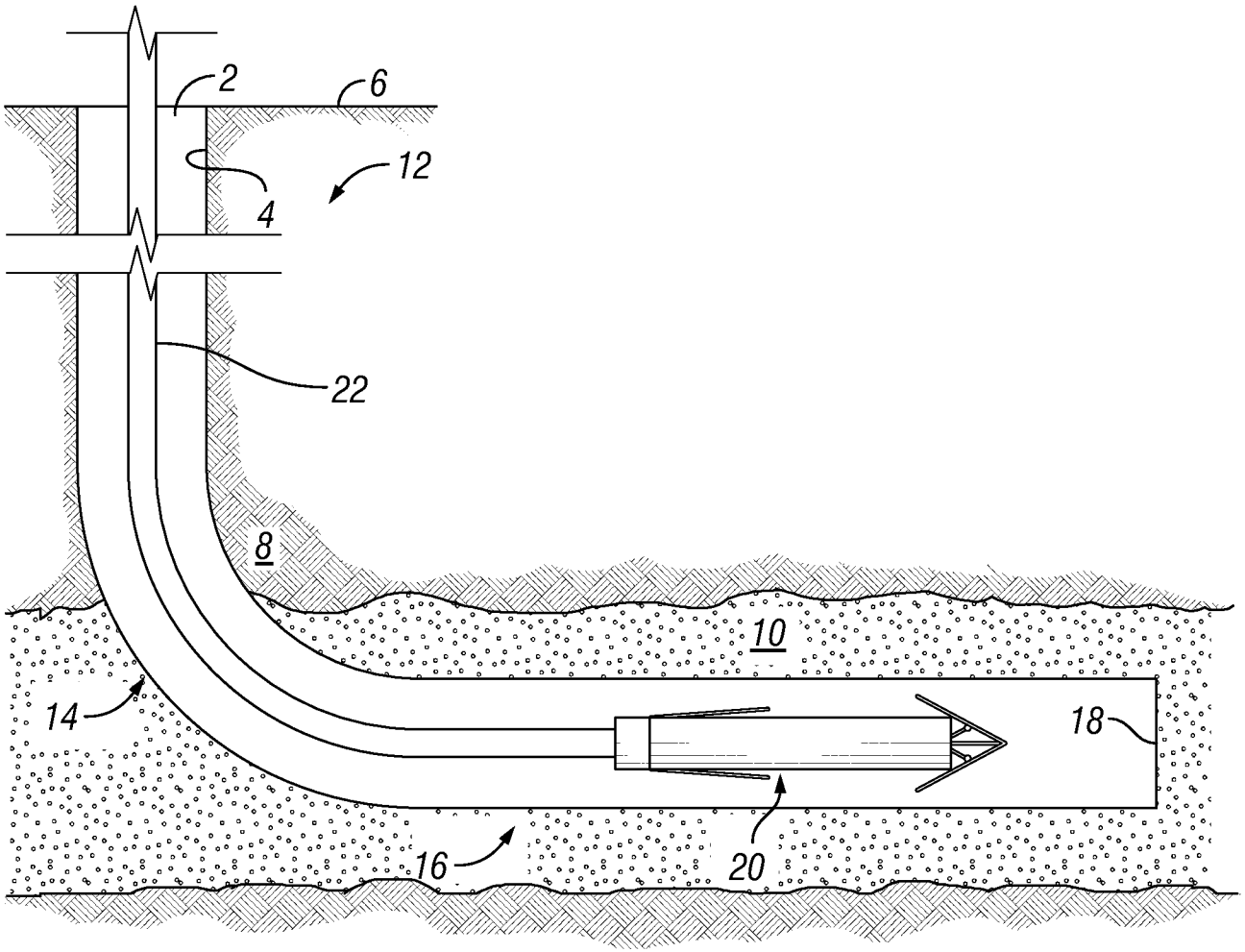
FIG. 1 is a section view of a subterranean well with a fracturing assembly in accordance with an embodiment of the disclosure.

Looking at FIG. 1, wellbore 2 of a subterranean well is a space defined by wellbore wall 4. Wellbore 2 forms a fluid pathway that extends from surface 6, through subterranean region 8 and into subterranean formation 10. Wellbore 2 can be used for hydrocarbon development operations. As an example, wellbore 2 can be used for producing fluids from subterranean formation 10. Subterranean formation 10 can contain, for example, hydrocarbons in gas or liquid form or water for production to surface 6. Alternately, wellbore 2 can be used for injecting fluids, such as water, into subterranean formation 10. Surface 6 can be an earth's surface. In alternate embodiments, surface 6 can be a seabed.

Wellbore 2 of the example embodiment of FIG. 1 has several sections, including vertical run 12, transition zone 14 and horizontal section 16. Horizontal section 16 extends in a generally horizontal direction from transition zone 14 until reaching the distal end of wellbore 2, which is wellbore face 18. In alternate embodiments, wellbore 2 can include only vertical run 12 or can include one or more sections that are deviated or inclined from vertical relative to surface 6. Wellbore 2 can be an uncased or open hole. In alternate embodiments, at least a portion of wellbore 2 can be lined with casing which is surrounded by cement.

Fracturing assembly 20 is located within wellbore 2. In FIG. 1, fracturing assembly 20 is located in horizontal section 16. However, fracturing assembly 20 can alternately be located in vertical run 12 or transition zone 14, depending on the location of subterranean formation 10 and the location of the target zone where the fracturing of subterranean formation 10 is desired. As an example, the target zone can be at a location for establishing communications between wellbore 2 and subterranean formation 10 to improve production. Fracturing assembly 20 can be used to form fractures in subterranean formation 10. Fracturing assembly 20 can be lowered into wellbore 2 on tubing 22. Tubing 22 extends into wellbore 2 and supports fracturing assembly 20 within wellbore 2. Tubing 22 can be tubing that is lowered into wellbore 2 riglessly such as coiled tubing.

Figure 2:
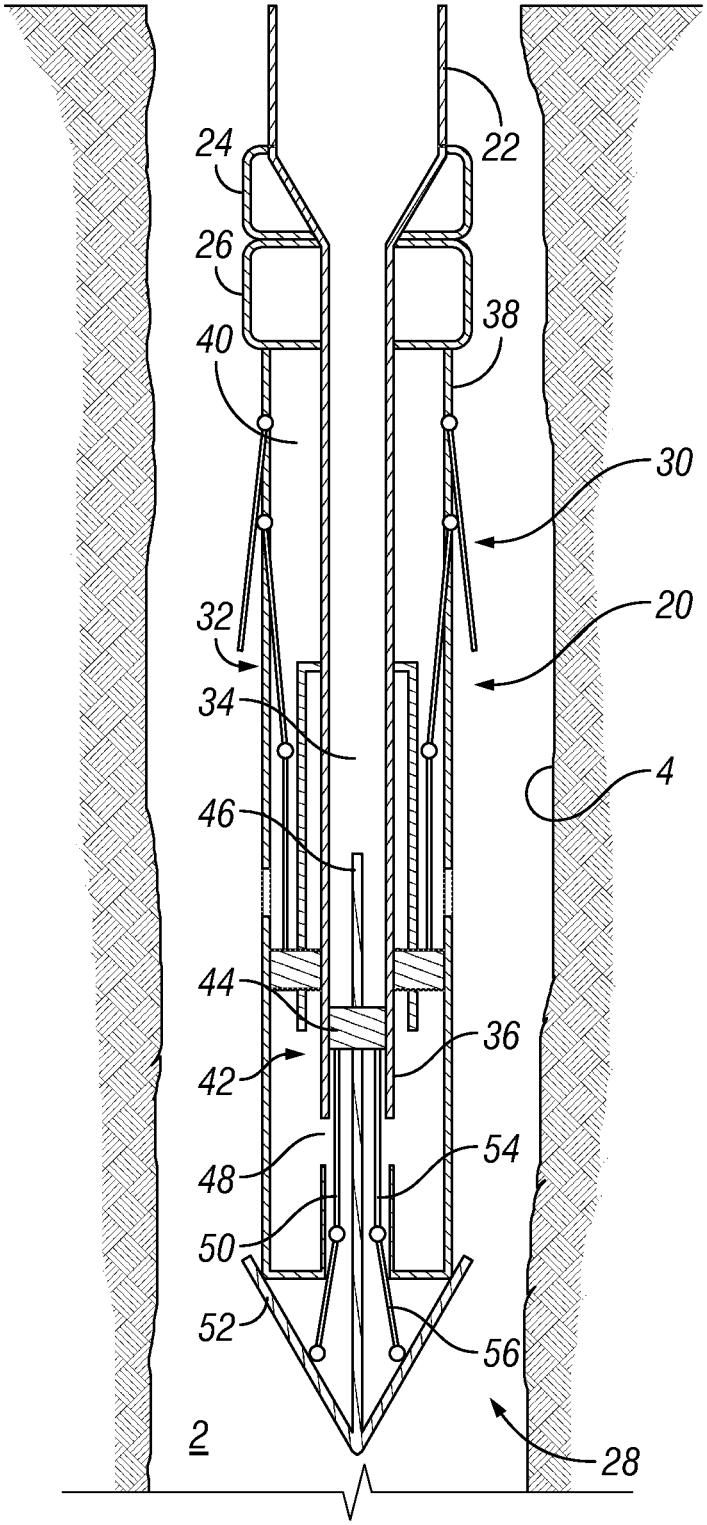
FIG. 2 is a section view of a fracturing assembly in accordance with an embodiment of the disclosure, shown with the downhole isolating assembly in the downhole unengaged position and with the uphole isolating assembly in the uphole unengaged position.

Looking at FIG. 2, fracturing assembly 20 can be secured to tubing 22 with tubing connector 24 and tool anchor 26. Fracturing assembly 20 includes downhole isolating assembly 28 and uphole isolating assembly 30 that together can isolate a target zone of wellbore 2 between downhole isolating assembly 28 and uphole isolating assembly 30 from other regions of wellbore 2. Such isolation will allow for fracturing of wellbore 2 in the region of wellbore 2 between downhole isolating assembly 28 and uphole isolating assembly 30.

Fracturing assembly 20 includes tool body 32. Tool body 32 has central bore 34. Central bore 34 is in fluid communication with the bore of tubing 22. Inner tubular member 36 of tool body 32 includes and defines central bore 34. Tool body 32 further includes outer tubular member 38. Outer tubular member 38 circumscribes inner tubular member 36. Annular space 40 is defined between an outside surface of inner tubular member 36 and an inner diameter surface of outer tubular member 38.

Figure 3:
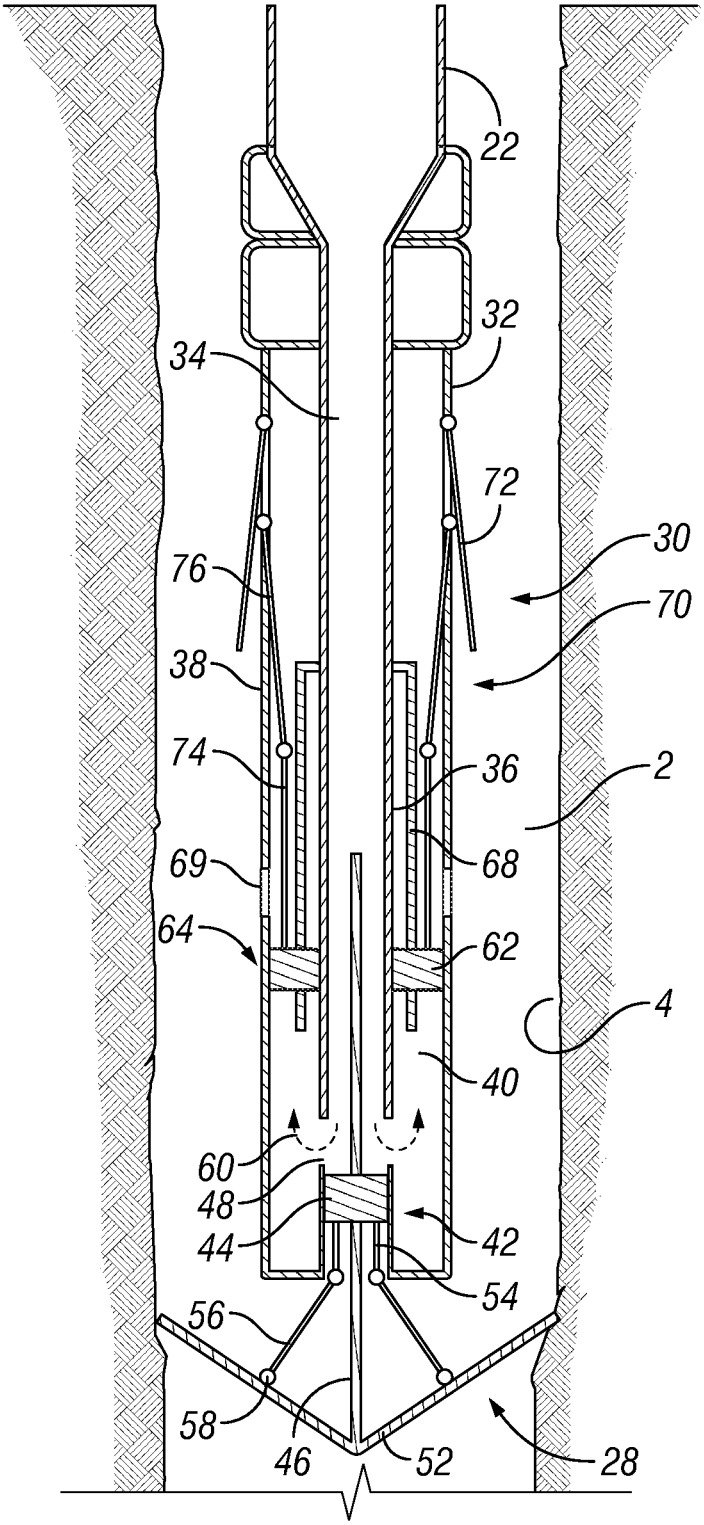
FIG. 3 is a section view of a fracturing assembly in accordance with an embodiment of the disclosure, shown with the downhole isolating assembly in the downhole engaged position and with the uphole isolating assembly in the uphole unengaged position.
Figure 4:
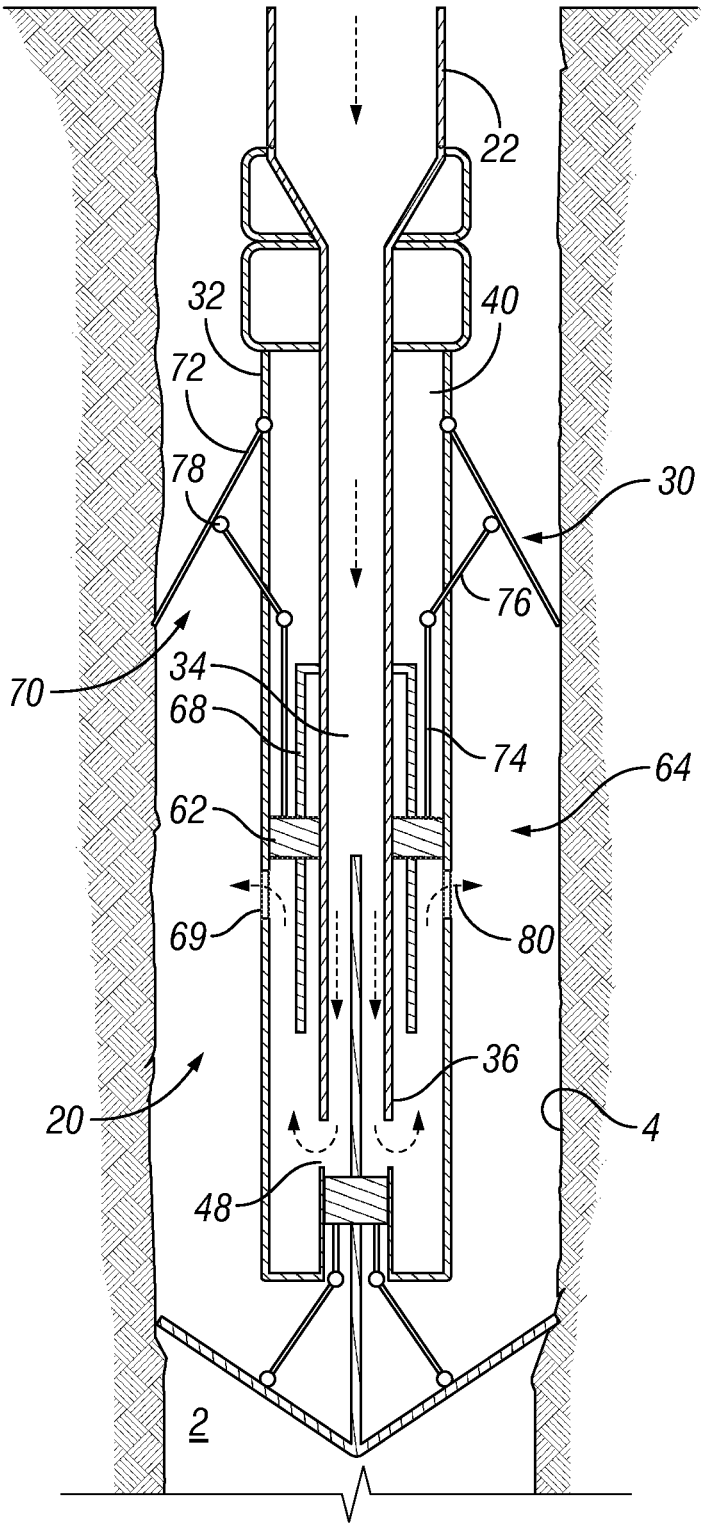
FIG. 4 is a section view of a fracturing assembly in accordance with an embodiment of the disclosure, shown with the downhole isolating assembly in the downhole engaged position and with the uphole isolating assembly in the uphole engaged position.

Downhole isolating assembly 28 is moveable between a downhole unengaged position (FIG. 2) and a downhole engaged position (FIGS. 3-4). In the downhole unengaged position of FIG. 2, downhole isolating assembly 28 is spaced apart from the inner diameter surface of wellbore wall 4. Fracturing assembly 20 can be lowered into wellbore 2 with downhole isolating assembly 28 in the downhole unengaged position.

Uphole isolating assembly 30 is moveable between an uphole unengaged position (FIGS. 2-3) and an uphole engaged position (FIG. 4). In the uphole unengaged position of FIG. 2, uphole isolating assembly 30 is spaced apart from the inner diameter surface of wellbore wall 4. Fracturing assembly 20 can be lowered into wellbore 2 with uphole isolating assembly 30 in the uphole unengaged position.

When fracturing assembly 20 has reached the target operating location within wellbore 2, downhole piston assembly 42 can be used to move downhole isolating assembly 28 between the downhole unengaged position and the downhole engaged position. In order to move downhole isolating assembly 28 between the downhole unengaged position and the downhole engaged position, downhole piston assembly 42 is moved between a downhole piston contracted position (FIG. 2) and a downhole piston extended position (FIGS. 3-4).

Downhole piston assembly 42 is in fluid communication with central bore 34 of tool body 32 so that downhole piston assembly 42 can be moved from the downhole piston contracted position to the downhole piston extended position by injecting a pressure fluid through central bore 34 of tool body 32. Downhole piston assembly 42 can be biased towards the downhole piston contracted position so that if there is insufficient pressure from the pressure fluid, downhole piston assembly 42 will return to the downhole piston contracted position. As an example, downhole piston assembly 42 can be spring loaded within tool body 32. Downhole piston assembly 42 can be spring loaded in a manner that retains downhole piston assembly 42 in the downhole piston contracted position until there is sufficient pressure from the pressure fluid to move downhole piston assembly 42 to the downhole piston extended position. The spring compression factor can be chosen so that downhole piston assembly 42 moves to the downhole piston extended position when a desired magnitude of pressure from the pressure fluid is applied.

Downhole piston assembly 42 includes downhole piston member 44 that forms a seal around the inner diameter surface of central bore 34 of tool body 32. Downhole piston assembly 42 further includes downhole piston rod 46. Downhole piston rod 46 is static relative to tool body 32. Downhole piston member 44 can slide along downhole piston rod 46 as downhole piston assembly 42 moves between the downhole piston contracted position and the downhole piston extended position.

Downhole port 48 extends through a sidewall of inner tubular member 36 and provides a fluid flow path between central bore 34 and annular space 40. When downhole piston assembly 42 is in the downhole piston contracted position of FIG. 2, downhole piston member 44 is located uphole of downhole port 48. In such a condition, pressure fluid injected into central bore 34 from tubing 22 is blocked by downhole piston member 44 from passing through downhole port 48.

Downhole isolating assembly 28 includes downhole structural assembly 50. Downhole structural assembly 50 is mechanically attached between downhole piston assembly 42 and downhole sealing member 52 and supports downhole sealing member 52. Downhole structural assembly 50 causes movement of downhole piston assembly 42 between the downhole piston contracted position and the downhole piston extended position to result in downhole isolating assembly 28 moving between the downhole unengaged position and the downhole engaged position.

In the example embodiment of FIG. 2, downhole structural assembly 50 has a plurality of downhole linear members 54 and a plurality of downhole pivoting members 56. In certain embodiments, each of the downhole linear members 54 is secured to one of the downhole pivoting member 56. Each of the downhole pivoting members is secured to downhole sealing member 52. Downhole linear members 54 and downhole pivoting members 56 can be formed, for example, of stainless steel.

Looking at FIG. 3, the pressure of pressure fluid injected through tubing 22 and into central bore 34 can be sufficient to overcome the bias of downhole piston assembly 42 towards the downhole piston contracted position as well as any friction or other opposing forces associated with downhole piston assembly 42 and downhole isolating assembly 28. At such a pressure the pressure fluid will cause downhole piston assembly 42 to move to, and remain in, the downhole piston extended position of FIG. 3, which results in downhole isolating assembly 28 moving to and remaining in the downhole engaged position of FIG. 3. As an example, pressure fluid can be injected with a pressure of 100 pounds per square inch (psi) to 300 psi for moving downhole piston assembly 42 from the downhole piston contracted position to the downhole piston extended position.

In the downhole engaged position, downhole isolating assembly 28 will form a seal with an inner diameter surface of wellbore wall 4 of wellbore 2. In the downhole engaged position downhole sealing member 52 can have a general inverted bell or umbrella shape. Downhole sealing member 52 can be formed of a material selected to form a seal in the environment of the particular well fluid properties of wellbore 2. As an example, of the wellbore fluid is a sweet crude hydrocarbon product, then downhole sealing member 52 could be formed of stainless steel. In alternate embodiments, if the wellbore fluid is a sour crude product, such as a crude product that includes hydrogen sulfide, downhole sealing member 52 could be formed of an austenitic nickel-chromium-based superalloy such as Inconel® (Inconel® is a registered trademark of Special Metals Corporation group of Companies).

Downhole isolating assembly 28 can be moved between the downhole unengaged position and the downhole engaged position in a manner similar to the operation of an umbrella. As downhole piston member 44 is pushed downhole under the force applied by the pressure fluid, downhole linear members 54 will be pushed linearly in a direction downhole. Downhole piston rod 46 is secured to a middle or central portion of downhole sealing member 52. Because downhole piston rod 46 is static relative to tool body 32, as downhole linear members 54 move linearly, downhole pivoting members 56 will pivot about downhole joints 58 at each end of each downhole pivoting member 56. Downhole pivoting members 56 will move downhole sealing member 52 radially outward to form a seal with wellbore wall 4 of wellbore 2.

With downhole piston assembly 42 in the downhole piston extended position, downhole piston member is located downhole of downhole port 48. In such a condition, pressure fluid injected into central bore 34 from tubing 22 can pass through downhole port 48 and into annular space 40 between the outside surface of inner tubular member 36 and the inner diameter surface of outer tubular member 38, as shown by arrows 60. The pressure fluid that passes through downhole port 48 can then act on uphole piston member 62 of uphole piston assembly 64. Uphole piston member 62 is ring shaped and forms a seal across annular space 40 of tool body 32.

With downhole piston assembly 42 in the downhole piston extended position, uphole piston assembly 64 can be used to move uphole isolating assembly 30 between the uphole unengaged position and the uphole engaged position. In order to move uphole isolating assembly 30 between the uphole unengaged position and the uphole engaged position, uphole piston assembly 64 is moved between an uphole piston contracted position (FIGS. 2-3) and an uphole piston extended position (FIG. 4).

Uphole piston assembly 64 is in fluid communication with central bore 34 of tool body 32 by way of downhole port 48 when downhole piston assembly 42 is in the downhole piston extended position so that uphole piston assembly 64 can be moved from the uphole piston contracted position to the uphole piston extended position by injecting a pressure fluid through central bore 34 of tool body 32.

Uphole piston assembly 64 is biased towards the uphole piston contracted position so that if there is insufficient pressure from the pressure fluid, uphole piston assembly 64 will return to the uphole piston contracted position. As an example, uphole piston assembly 64 can be spring loaded within tool body 32. Uphole piston assembly 64 can be spring loaded in a manner that retains uphole piston assembly 64 in the uphole piston contracted position until there is sufficient pressure from the pressure fluid to move uphole piston assembly 64 to the upnhole piston extended position. The spring compression factor can be chosen so that uphole piston assembly 64 moves to the uphole piston extended position when a desired magnitude of pressure from the pressure fluid is applied.

Uphole piston assembly 64 further includes a plurality of uphole piston rods 68. Each of the plurality of uphole piston rods 68 are static relative to tool body 32. The plurality of uphole piston rods are spaced around a circumference within annular space 40. Uphole piston member 62 can slide along the plurality of uphole piston rods 68 as uphole piston assembly 64 moves between the uphole piston contracted position and the uphole piston extended position.

Uphole port 69 extends through a sidewall of outer tubular member 38 and provides a fluid flow path between annular space 40 and wellbore 2. When uphole piston assembly 64 is in the uphole piston contracted position of FIG. 3, uphole piston member 62 is located downhole of uphole port 69. In such a condition, pressure fluid injected into annular space 40 from tubing 22 by way of central bore 34 is blocked by uphole piston member 62 from passing through uphole port 69.

Uphole isolating assembly 30 includes uphole structural assembly 70. Uphole structural assembly 70 is mechanically attached between uphole piston assembly 64 and uphole sealing member 72 and supports uphole sealing member 72. Uphole structural assembly 70 causes movement of uphole piston assembly 64 between the uphole piston contracted position and the uphole piston extended position to result in uphole isolating assembly 30 moving between the uphole unengaged position and the uphole engaged position.

Uphole structural assembly 70 has a plurality of uphole linear members 74 and a plurality of uphole pivoting members 76. The plurality of uphole linear members 74 are spaced around a circumference within annular space 40. In certain embodiments, each of the plurality of uphole linear members 74 is secured to one of the uphole pivoting member 76. Each of the uphole pivoting members 76 is secured to uphole sealing member 72.

Looking at FIG. 4, the pressure of pressure fluid injected through tubing 22, into central bore 34 and into annular space 40 can be sufficient to overcome the bias of uphole piston assembly 64 towards the uphole piston contracted position as well as any friction or other opposing forces associated with uphole piston assembly 64 and uphole isolating assembly 30. At such a pressure the pressure fluid will cause uphole piston assembly 64 to move to and remain in the uphole piston extended position of FIG. 4, and results in uphole isolating assembly 30 moving to and remaining in the uphole engaged position of FIG. 4. As an example, pressure fluid can be injected with a pressure of 100 psi to 300 psi for moving uphole piston assembly 64 from the uphole piston contracted position to the uphole piston extended position.

In the uphole engaged position, uphole isolating assembly 30 will form a seal with an inner diameter surface of wellbore wall 4 of wellbore 2. In the uphole engaged position uphole sealing member 72 can have a generally frusto-conical shape, or a generally inverted partial bell or umbrella shape. As uphole piston member 62 is pushed uphole along uphole piston rods 68 under the force applied by the pressure fluid, uphole linear members 74 will be pushed linearly in a direction uphole. An uphole inner diameter edge of uphole sealing member 72 is axially static relative to tool body 32. Therefore, as uphole linear members 74 of uphole structural assembly 70 move in an uphole direction, uphole pivoting members 76 will pivot about uphole joints 78 at each end of each uphole pivoting member 76. Uphole pivoting members 76 will move uphole sealing member 72 radially outward to form a seal with wellbore wall 4 of wellbore 2.

With uphole piston assembly 64 in the uphole piston extended position, uphole piston member 62 is located uphole of uphole port 69. In such a condition, central bore 34 is in fluid communication with wellbore 2 and pressure fluid injected into central bore 34 from tubing 22 can pass through downhole port 48, uphole port 69 and into wellbore 2, as shown by arrows 80. The pressure fluid that passes through uphole port 69 can be used to hydraulically fracture subterranean formation 10. As an example, pressure fluid can be injected with a pressure of 8,000 psi to 10,000 psi for hydraulically fracturing subterranean formation 10. Pressure fluid can be a fluid known to be used for hydraulic fracturing and can be, as an example, a nonviscous water based solution or fresh water.

When the pressure of pressure fluid that is injected through tubing 22 is reduced, uphole isolating assembly is biased to return to the uphole unengaged position and downhole isolating assembly is biased to return to the downhole unengaged position. Fracturing assembly 20 can then be relocated within wellbore 2 or removed from wellbore 2 in a rigless operation.

In an example of operation, in order to hydraulically fracture subterranean formation 10, fracturing assembly 20 can be lowered into wellbore 2 with tubing 22 in a rigless operation. When the target zone of subterranean formation 10 is reached by fracturing assembly 20, a pressure fluid can be injected through tubing 22 and into central bore 34 of tool body 32. The pressure fluid will act on downhole piston member 44 and move downhole piston member 44 in a downhole direction. Such downhole movement of downhole piston member 44 will result in downhole sealing member 52 forming a seal with wellbore wall 4 of wellbore 2 with downhole isolating assembly 28 in the downhole engaged position.

When downhole isolating assembly 28 is in the downhole engaged position, downhole piston member 44 is downhole of downhole port 48. Pressure fluid injected through tubing 22 and into central bore 34 of tool body 32 can then pass through downhole port 48 and into annular space 40 between the outside surface of inner tubular member 36 and the inner diameter surface of outer tubular member 38. This pressure fluid can act on uphole piston member 62, moving uphole piston member 62 in an uphole direction. Such uphole movement of uphole piston member 62 will result in uphole sealing member 72 forming a seal with wellbore wall 4 of wellbore 2 with uphole isolating assembly 30 in the uphole engaged position.

When uphole isolating assembly 30 is in the uphole engaged position, uphole piston member 62 is uphole of uphole port 69 and central bore 34 is in fluid communication with wellbore 2. Pressure fluid injected through tubing 22 and into central bore 34 can then be used to hydraulically fracture subterranean formation 10 in the target zone between downhole isolating assembly 28 and uphole isolating assembly 30.

When the hydraulic fracturing operations have been completed, the pressure of pressure fluid that is injected through tubing 22 is reduced. With uphole isolating assembly 30 biased towards the uphole unengaged position uphole sealing member 72 will move radially inward and no longer form a seal with wellbore wall 4. With downhole isolating assembly 28 biased towards the downhole unengaged position, downhole sealing member 52 will move radially inward and no longer form a seal with wellbore wall 4. Fracturing assembly 20 can then be relocated within wellbore 2 or removed from wellbore 2 in a rigless operation.

Embodiments of the disclosure described are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A fracturing assembly for hydraulically fracturing a subterranean formation, the fracturing assembly including:

a tool body, the tool body having a central bore;

a downhole isolating assembly, the downhole isolating assembly moveable between a downhole unengaged position and a downhole engaged position, where in the downhole engaged position the downhole isolating assembly is operable to form a seal with an inner diameter surface of a wellbore;

a downhole piston assembly in fluid communication with the central bore of the tool body, the downhole piston assembly moveable between a downhole piston contracted position and a downhole piston extended position, where the downhole piston assembly is operable to move the downhole isolating assembly between the downhole unengaged position and the downhole engaged position, where the downhole piston assembly includes a downhole piston member that forms a seal around an inner diameter surface of the central bore of the tool body, and where the downhole piston assembly further includes a downhole piston rod that is static relative to the tool body, and where the downhole piston member is operable to slide along the downhole piston rod;

an uphole isolating assembly, the uphole isolating assembly moveable between an uphole unengaged position and an uphole engaged position, where in the uphole engaged position the uphole isolating assembly is operable to form a seal with the inner diameter surface of the wellbore; and an uphole piston assembly moveable between an uphole piston contracted position and an uphole piston extended position, where the uphole piston assembly is in fluid communication with the central bore of the tool body when the downhole piston assembly is in the downhole piston extended position, and where the uphole piston assembly is operable to move the uphole isolating assembly between the uphole unengaged position and the uphole engaged position.

2. The fracturing assembly of claim 1, where the downhole piston assembly is biased towards the downhole piston contracted position and the uphole piston assembly is biased towards the uphole piston contracted position.

3. The fracturing assembly of claim 1, where the tool body further includes an annular space between an outside surface of an inner tubular member, and an inner diameter surface of an outer tubular member.

4. The fracturing assembly of claim 3, where the uphole piston assembly includes an uphole piston member that is ring shaped and forms a seal in the annular space of the tool body.

5. The fracturing assembly of claim 4, where the uphole piston assembly further includes a plurality of uphole piston rods each of the plurality of uphole piston rods being static relative to the tool body, and where the uphole piston member is operable to slide along the plurality of uphole piston rods.

6. The fracturing assembly of claim 4, where the tool body further includes an uphole port extending through the outer tubular member, where the uphole piston member is located downhole of the uphole port when the uphole isolating assembly is in the uphole unengaged position and the uphole piston member is located uphole of the uphole port when the uphole isolating assembly is in the uphole engaged position.

7. The fracturing assembly of claim 1, where the tool body further includes an inner tubular member that defines the central bore, and a downhole port extending through the inner tubular member, where the downhole piston member is located uphole of the downhole port when the downhole piston assembly is in the downhole piston contracted position and the downhole piston member is located downhole of the downhole port when the downhole piston assembly is in the downhole piston extended position.

8. The fracturing assembly of claim 1, where the downhole isolating assembly includes a downhole structural assembly having a plurality of downhole linear members, and a plurality of downhole pivoting members, and the downhole isolating assembly further includes a downhole sealing member, where the each of the plurality of downhole linear members is secured to one of the plurality of downhole pivoting members and each of the plurality of downhole pivoting members is secured to the downhole sealing member.

9. The fracturing assembly of claim 1, where the uphole isolating assembly includes an uphole structural assembly having a plurality of uphole linear members, and a plurality of uphole pivoting members, and the uphole isolating assembly further includes an uphole sealing member, where each of the plurality of uphole linear members is secured to one of the plurality of uphole pivoting members and each of the plurality of uphole pivoting members is secured to the uphole sealing member.

10. The fracturing assembly of claim 1, where the central bore of the tool body is in fluid communication with the wellbore when the downhole isolating assembly is in the downhole engaged position and the uphole isolating assembly is in the uphole engaged position.

11. A method for hydraulically fracturing a subterranean formation with a fracturing assembly, the method including:

providing a tool body having a central bore;

providing a downhole isolating assembly, the downhole isolating assembly moveable between a downhole unengaged position and a downhole engaged position, where in the downhole engaged position the downhole isolating assembly forms a seal with an inner diameter surface of a wellbore;

providing a downhole piston assembly in fluid communication with the central bore of the tool body, the downhole piston assembly moveable between a downhole piston contracted position and a downhole piston extended position, and forming a seal around an inner diameter surface of the central bore of the tool body with a downhole piston member of the downhole piston assembly;

providing an uphole isolating assembly, the uphole isolating assembly moveable between an uphole unengaged position and an uphole engaged position, where in the uphole engaged position the uphole isolating assembly forms a seal with the inner diameter surface of the wellbore;

providing an uphole piston assembly moveable between an uphole piston contracted position and an uphole piston extended position, where the uphole piston assembly is in fluid communication with the central bore of the tool body when the downhole piston assembly is in the downhole piston extended position;

moving the downhole piston assembly between the downhole piston contracted position and the downhole piston extended position by sliding the downhole piston member along a downhole piston rod, where the downhole piston rod is static relative to the tool body;

moving the downhole isolating assembly between the downhole unengaged position and the downhole engaged position with the downhole piston assembly; and moving the uphole isolating assembly between the uphole unengaged position and the uphole engaged position with the uphole piston assembly.

12. The method of claim 11, further including biasing the downhole piston assembly towards the downhole piston contracted position and biasing the uphole isolating assembly towards the uphole piston contracted position.

13. The method of claim 11, further including sealing an annular space between an outside surface of an inner tubular member of the tool body and an inner diameter surface of an outer tubular member of the tool body with an uphole piston member of the uphole piston assembly.

14. The method of claim 13, further including moving the uphole piston assembly between the uphole piston contracted position and the uphole piston extended position by sliding the uphole piston member along a plurality of uphole piston rods, where each of the plurality of uphole piston rods is static relative to the tool body.

15. The method of claim 13, where the outer tubular member has an uphole port extending through the outer tubular member, the method further including moving the uphole piston member from downhole of the uphole port to uphole of the uphole port by moving the uphole isolating assembly from the uphole unengaged position to the uphole engaged position.

16. The fracturing assembly of claim 11, where the tool body further includes an inner tubular member that defines the central bore, and a downhole port extending through the inner tubular member, the method further including moving the downhole piston member from uphole of the downhole port to downhole of the downhole port by moving the downhole piston assembly from the downhole piston contracted position to the downhole piston extended position.

17. The method of claim 11, where the central bore of the tool body is in fluid communication with the wellbore when the downhole isolating assembly is in the downhole engaged position and the uphole isolating assembly is in the uphole engaged position.

18. The method of claim 11, where:

moving the downhole isolating assembly from the downhole unengaged position to the downhole engaged position with the downhole piston assembly includes injecting a pressure fluid through the central bore;

moving the uphole isolating assembly from the uphole unengaged position to the uphole engaged position with the uphole piston assembly includes injecting the pressure fluid through the central bore after the downhole isolating assembly is in the downhole engaged position; and the method further includes fracturing the subterranean formation with the pressure fluid after the uphole isolating assembly is in the uphole engaged position.

19. A fracturing assembly for hydraulically fracturing a subterranean formation, the fracturing assembly including:

a tool body, the tool body having a central bore where the tool body further includes an annular space between an outside surface of an inner tubular member, and an inner diameter surface of an outer tubular member;

a downhole isolating assembly, the downhole isolating assembly moveable between a downhole unengaged position and a downhole engaged position, where in the downhole engaged position the downhole isolating assembly is operable to form a seal with an inner diameter surface of a wellbore;

a downhole piston assembly in fluid communication with the central bore of the tool body, the downhole piston assembly moveable between a downhole piston contracted position and a downhole piston extended position, where the downhole piston assembly is operable to move the downhole isolating assembly between the downhole unengaged position and the downhole engaged position;

an uphole isolating assembly, the uphole isolating assembly moveable between an uphole unengaged position and an uphole engaged position, where in the uphole engaged position the uphole isolating assembly is operable to form a seal with the inner diameter surface of the wellbore; and an uphole piston assembly moveable between an uphole piston contracted position and an uphole piston extended position, where the uphole piston assembly is in fluid communication with the central bore of the tool body when the downhole piston assembly is in the downhole piston extended position, where the uphole piston assembly is operable to move the uphole isolating assembly between the uphole unengaged position and the uphole engaged position; where the uphole piston assembly includes an uphole piston member that is ring shaped and forms a seal in the annular space of the tool body, and where the uphole piston assembly further includes a plurality of uphole piston rods each of the plurality of uphole piston rods being static relative to the tool body, and where the uphole piston member is operable to slide along the plurality of uphole piston rods.

20. A fracturing assembly for hydraulically fracturing a subterranean formation, the fracturing assembly including:

a tool body, the tool body having a central bore, where the tool body further includes an annular space between an outside surface of an inner tubular member, and an inner diameter surface of an outer tubular member, and where the tool body further includes an uphole port extending through the outer tubular member;

a downhole isolating assembly, the downhole isolating assembly moveable between a downhole unengaged position and a downhole engaged position, where in the downhole engaged position the downhole isolating assembly is operable to form a seal with an inner diameter surface of a wellbore;

a downhole piston assembly in fluid communication with the central bore of the tool body, the downhole piston assembly moveable between a downhole piston contracted position and a downhole piston extended position, where the downhole piston assembly is operable to move the downhole isolating assembly between the downhole unengaged position and the downhole engaged position;

an uphole isolating assembly, the uphole isolating assembly moveable between an uphole unengaged position and an uphole engaged position, where in the uphole engaged position the uphole isolating assembly is operable to form a seal with the inner diameter surface of the wellbore; and an uphole piston assembly moveable between an uphole piston contracted position and an uphole piston extended position, where the uphole piston assembly is in fluid communication with the central bore of the tool body when the downhole piston assembly is in the downhole piston extended position, where the uphole piston assembly is operable to move the uphole isolating assembly between the uphole unengaged position and the uphole engaged position; where the uphole piston assembly includes an uphole piston member that is ring shaped and forms a seal in the annular space of the tool body, and where the uphole piston member is located downhole of the uphole port when the uphole isolating assembly is in the uphole unengaged position and the uphole piston member is located uphole of the uphole port when the uphole isolating assembly is in the uphole engaged position.

21. A fracturing assembly for hydraulically fracturing a subterranean formation, the fracturing assembly including:

a tool body, the tool body having a central bore, where the tool body further includes an inner tubular member that defines the central bore, and a downhole port extending through the inner tubular member;

a downhole isolating assembly, the downhole isolating assembly moveable between a downhole unengaged position and a downhole engaged position, where in the downhole engaged position the downhole isolating assembly is operable to form a seal with an inner diameter surface of a wellbore;

a downhole piston assembly in fluid communication with the central bore of the tool body, the downhole piston assembly moveable between a downhole piston contracted position and a downhole piston extended position, where the downhole piston assembly is operable to move the downhole isolating assembly between the downhole unengaged position and the downhole engaged position, where the downhole piston assembly includes a downhole piston member that forms a seal around an inner diameter surface of the central bore of the tool body, where the downhole piston member is located uphole of the downhole port when the downhole piston assembly is in the downhole piston contracted position and the downhole piston member is located downhole of the downhole port when the downhole piston assembly is in the downhole piston extended position;

an uphole isolating assembly, the uphole isolating assembly moveable between an uphole unengaged position and an uphole engaged position, where in the uphole engaged position the uphole isolating assembly is operable to form a seal with the inner diameter surface of the wellbore; and an uphole piston assembly moveable between an uphole piston contracted position and an uphole piston extended position, where the uphole piston assembly is in fluid communication with the central bore of the tool body when the downhole piston assembly is in the downhole piston extended position, and where the uphole piston assembly is operable to move the uphole isolating assembly between the uphole unengaged position and the uphole engaged position.

22. A fracturing assembly for hydraulically fracturing a subterranean formation, the fracturing assembly including:

a tool body, the tool body having a central bore;

a downhole isolating assembly, the downhole isolating assembly moveable between a downhole unengaged position and a downhole engaged position, where in the downhole engaged position the downhole isolating assembly is operable to form a seal with an inner diameter surface of a wellbore, where the downhole isolating assembly includes a downhole structural assembly having a plurality of downhole linear members, and a plurality of downhole pivoting members, and the downhole isolating assembly further includes a downhole sealing member, where each of the plurality of downhole linear members is secured to one of the plurality of downhole pivoting members and each of the plurality of downhole pivoting members is secured to the downhole sealing member;

a downhole piston assembly in fluid communication with the central bore of the tool body, the downhole piston assembly moveable between a downhole piston contracted position and a downhole piston extended position, where the downhole piston assembly is operable to move the downhole isolating assembly between the downhole unengaged position and the downhole engaged position;

an uphole isolating assembly, the uphole isolating assembly moveable between an uphole unengaged position and an uphole engaged position, where in the uphole engaged position the uphole isolating assembly is operable to form a seal with the inner diameter surface of the wellbore; and an uphole piston assembly moveable between an uphole piston contracted position and an uphole piston extended position, where the uphole piston assembly is in fluid communication with the central bore of the tool body when the downhole piston assembly is in the downhole piston extended position, and where the uphole piston assembly is operable to move the uphole isolating assembly between the uphole unengaged position and the uphole engaged position.

23. A fracturing assembly for hydraulically fracturing a subterranean formation, the fracturing assembly including:

a tool body, the tool body having a central bore;

a downhole isolating assembly, the downhole isolating assembly moveable between a downhole unengaged position and a downhole engaged position, where in the downhole engaged position the downhole isolating assembly is operable to form a seal with an inner diameter surface of a wellbore;

a downhole piston assembly in fluid communication with the central bore of the tool body, the downhole piston assembly moveable between a downhole piston contracted position and a downhole piston extended position, where the downhole piston assembly is operable to move the downhole isolating assembly between the downhole unengaged position and the downhole engaged position;

an uphole isolating assembly, the uphole isolating assembly moveable between an uphole unengaged position and an uphole engaged position, where in the uphole engaged position the uphole isolating assembly is operable to form a seal with the inner diameter surface of the wellbore, where the uphole isolating assembly includes an uphole structural assembly having a plurality of uphole linear members, and a plurality of uphole pivoting members, and the uphole isolating assembly further includes an uphole sealing member, where each of the plurality of uphole linear members is secured to one of the plurality of uphole pivoting members and each of the plurality of uphole pivoting members is secured to the uphole sealing member; and an uphole piston assembly moveable between an uphole piston contracted position and an uphole piston extended position, where the uphole piston assembly is in fluid communication with the central bore of the tool body when the downhole piston assembly is in the downhole piston extended position, and where the uphole piston assembly is operable to move the uphole isolating assembly between the uphole unengaged position and the uphole engaged position.

24. A method for hydraulically fracturing a subterranean formation with a fracturing assembly, the method including:

providing a tool body having a central bore;

providing a downhole isolating assembly, the downhole isolating assembly moveable between a downhole unengaged position and a downhole engaged position, where in the downhole engaged position the downhole isolating assembly forms a seal with an inner diameter surface of a wellbore;

providing a downhole piston assembly in fluid communication with the central bore of the tool body, the downhole piston assembly moveable between a downhole piston contracted position and a downhole piston extended position;

providing an uphole isolating assembly, the uphole isolating assembly moveable between an uphole unengaged position and an uphole engaged position, where in the uphole engaged position the uphole isolating assembly forms a seal with the inner diameter surface of the wellbore;

providing an uphole piston assembly moveable between an uphole piston contracted position and an uphole piston extended position, where the uphole piston assembly is in fluid communication with the central bore of the tool body when the downhole piston assembly is in the downhole piston extended position;

moving the downhole isolating assembly between the downhole unengaged position and the downhole engaged position with the downhole piston assembly;

moving the uphole isolating assembly between the uphole unengaged position and the uphole engaged position with the uphole piston assembly;

sealing an annular space between an outside surface of an inner tubular member of the tool body and an inner diameter surface of an outer tubular member of the tool body with an uphole piston member of the uphole piston assembly; and moving the uphole piston assembly between the uphole piston contracted position and the uphole piston extended position by sliding the uphole piston member along a plurality of uphole piston rods, where each of the plurality of uphole piston rods is static relative to the tool body.

25. A method for hydraulically fracturing a subterranean formation with a fracturing assembly, the method including:

providing a tool body having a central bore;

providing a downhole isolating assembly, the downhole isolating assembly moveable between a downhole unengaged position and a downhole engaged position, where in the downhole engaged position the downhole isolating assembly forms a seal with an inner diameter surface of a wellbore;

providing a downhole piston assembly in fluid communication with the central bore of the tool body, the downhole piston assembly moveable between a downhole piston contracted position and a downhole piston extended position;

providing an uphole isolating assembly, the uphole isolating assembly moveable between an uphole unengaged position and an uphole engaged position, where in the uphole engaged position the uphole isolating assembly forms a seal with the inner diameter surface of the wellbore;

providing an uphole piston assembly moveable between an uphole piston contracted position and an uphole piston extended position, where the uphole piston assembly is in fluid communication with the central bore of the tool body when the downhole piston assembly is in the downhole piston extended position;

moving the downhole isolating assembly between the downhole unengaged position and the downhole engaged position with the downhole piston assembly;

moving the uphole isolating assembly between the uphole unengaged position and the uphole engaged position with the uphole piston assembly;

sealing an annular space between an outside surface of an inner tubular member of the tool body and an inner diameter surface of an outer tubular member of the tool body with an uphole piston member of the uphole piston assembly, where the outer tubular member has an uphole port extending through the outer tubular member; and moving the uphole piston member from downhole of the uphole port to uphole of the uphole port by moving the uphole isolating assembly from the uphole unengaged position to the uphole engaged position.

26. A method for hydraulically fracturing a subterranean formation with a fracturing assembly, the method including:

providing a tool body having a central bore, where the tool body further includes an inner tubular member that defines the central bore, and a downhole port extending through the inner tubular member;

providing a downhole isolating assembly, the downhole isolating assembly moveable between a downhole unengaged position and a downhole engaged position, where in the downhole engaged position the downhole isolating assembly forms a seal with an inner diameter surface of a wellbore;

providing a downhole piston assembly in fluid communication with the central bore of the tool body, the downhole piston assembly moveable between a downhole piston contracted position and a downhole piston extended position, and forming a seal around an inner diameter surface of the central bore of the tool body with a downhole piston member of the downhole piston assembly;

providing an uphole isolating assembly, the uphole isolating assembly moveable between an uphole unengaged position and an uphole engaged position, where in the uphole engaged position the uphole isolating assembly forms a seal with the inner diameter surface of the wellbore;

providing an uphole piston assembly moveable between an uphole piston contracted position and an uphole piston extended position, where the uphole piston assembly is in fluid communication with the central bore of the tool body when the downhole piston assembly is in the downhole piston extended position;

moving the downhole isolating assembly between the downhole unengaged position and the downhole engaged position with the downhole piston assembly;

moving the uphole isolating assembly between the uphole unengaged position and the uphole engaged position with the uphole piston assembly; and moving the downhole piston member from uphole of the downhole port to downhole of the downhole port by moving the downhole piston assembly from the downhole piston contracted position to the downhole piston extended position.

27. A method for hydraulically fracturing a subterranean formation with a fracturing assembly, the method including:

providing a tool body having a central bore;

providing a downhole isolating assembly, the downhole isolating assembly moveable between a downhole unengaged position and a downhole engaged position, where in the downhole engaged position the downhole isolating assembly forms a seal with an inner diameter surface of a wellbore;

providing a downhole piston assembly in fluid communication with the central bore of the tool body, the downhole piston assembly moveable between a downhole piston contracted position and a downhole piston extended position;

providing an uphole isolating assembly, the uphole isolating assembly moveable between an uphole unengaged position and an uphole engaged position, where in the uphole engaged position the uphole isolating assembly forms a seal with the inner diameter surface of the wellbore;

providing an uphole piston assembly moveable between an uphole piston contracted position and an uphole piston extended position, where the uphole piston assembly is in fluid communication with the central bore of the tool body when the downhole piston assembly is in the downhole piston extended position;

moving the downhole isolating assembly between the downhole unengaged position and the downhole engaged position with the downhole piston assembly, where moving the downhole isolating assembly from the downhole unengaged position to the downhole engaged position with the downhole piston assembly includes injecting a pressure fluid through the central bore;

moving the uphole isolating assembly between the uphole unengaged position and the uphole engaged position with the uphole piston assembly, where moving the uphole isolating assembly from the uphole unengaged position to the uphole engaged position with the uphole piston assembly includes injecting the pressure fluid through the central bore after the downhole isolating assembly is in the downhole engaged position; and fracturing the subterranean formation with the pressure fluid after the uphole isolating assembly is in the uphole engaged position.

* * * * *